US011497948B2

(12) United States Patent
Monahan et al.

(10) Patent No.: US 11,497,948 B2
(45) Date of Patent: Nov. 15, 2022

(54) HARNESS BACK PLATE AND STRAP ARRANGEMENT

(71) Applicant: MSA Technology, LLC, Cranberry Township, PA (US)

(72) Inventors: Michael D. Monahan, Allison Park, PA (US); Mark Allen Hall, Cranberry Township, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 292 days.

(21) Appl. No.: 16/599,814

(22) Filed: Oct. 11, 2019

(65) Prior Publication Data

US 2020/0114180 A1 Apr. 16, 2020

Related U.S. Application Data

(60) Provisional application No. 62/745,034, filed on Oct. 12, 2018.

(51) Int. Cl.
*A47L 3/04* (2006.01)
*A62B 35/00* (2006.01)

(52) U.S. Cl.
CPC ..... *A62B 35/0025* (2013.01); *A62B 35/0018* (2013.01); *A62B 35/0031* (2013.01)

(58) Field of Classification Search
CPC ..... A62B 35/0025; A62B 35/0018; A62B 35/0031; A41D 13/0506; A41D 13/0007; B63H 8/54
See application file for complete search history.

(56) References Cited

U.S. PATENT DOCUMENTS 4,112,865 A * 9/1978 Carn ..... B63H 8/54 114/39.18
5,403,002 A * 4/1995 Brunty ..... A61F 5/013 473/438

(Continued)

FOREIGN PATENT DOCUMENTS

CN 101879359 A 11/2010
CN 106999743 A 8/2017

(Continued)

OTHER PUBLICATIONS https://worldwide.espacenet.com/publicationDetails/biblio?II=1&ND=3&adjacent=true&locale=en_EP&FT=D&date=20150427&CC=JP&NR=2015080578A&KC=A (Year: 2021).*

*Primary Examiner* — Jerry E Redman
(74) *Attorney, Agent, or Firm* — Jones Day

(57) ABSTRACT

A wearable body harness has first and second shoulder straps arranged in an X-shape, a back plate on a rear portion of the shoulder straps with the first shoulder strap crossing over the second at the back plate. The back plate includes a pair of lower guide slots, having a first lower guide slot side and a second lower guide slot side contiguous with the first and arranged at an angle relative thereto, and a pair of upper guide slots, having a first upper guide slot side and a second upper guide slot side contiguous with the first and arranged at an angle relative thereto. A first of the pair of upper and lower guide slots route a webbing material of the first shoulder strap. A second of the pair of upper and the pair of lower guide slots route the webbing material of the second shoulder strap.

19 Claims, 12 Drawing Sheets

(56) References Cited

U.S. PATENT DOCUMENTS

| | | | | |
|---|---|---|---|---|
| 6,253,874 | B1 * | 7/2001 | Casebolt | A62B 35/0031 182/3 |
| 6,857,820 | B2 * | 2/2005 | Jacoway | B63C 11/02 224/627 |
| 7,073,627 | B2 * | 7/2006 | Casebolt | A62B 35/0031 119/770 |
| 7,178,632 | B2 | 2/2007 | Casebolt et al. | |
| 8,177,025 | B2 * | 5/2012 | Lang | A62B 35/0031 182/3 |
| 8,375,467 | B2 * | 2/2013 | Real | A41D 13/0007 2/69 |
| 8,387,844 | B2 | 3/2013 | Wrigley et al. | |
| 8,418,898 | B2 * | 4/2013 | Carlsson | B25H 1/0028 224/162 |
| 9,084,906 | B2 * | 7/2015 | Schurian | A62B 35/0037 |
| 10,757,991 | B2 * | 9/2020 | Patz | A41D 3/00 |
| 10,775,142 | B1 * | 9/2020 | Pineda | A45F 5/00 |
| 2004/0065272 | A1 * | 4/2004 | Reynolds | A62B 35/0018 119/770 |
| 2013/0152267 | A1 * | 6/2013 | Real | A62B 35/0018 2/69 |
| 2015/0165247 | A1 * | 6/2015 | Mursu | A62B 35/0025 2/465 |
| 2016/0332010 | A1 * | 11/2016 | Lowell | A62B 35/0018 |
| 2017/0216635 | A1 | 8/2017 | Stibilj | |
| 2018/0161607 | A1 * | 6/2018 | Jacob | A62B 35/04 |
| 2019/0001165 | A1 * | 1/2019 | Schurian | A62B 35/0075 |
| 2020/0008537 | A1 * | 1/2020 | Sepe | A62B 35/0006 |
| 2020/0114181 | A1 * | 4/2020 | Monahan | A62B 35/0031 |
| 2020/0155879 | A1 * | 5/2020 | Chang | A62B 35/0037 |
| 2020/0406072 | A1 * | 12/2020 | Monahan | A62B 35/0037 |

FOREIGN PATENT DOCUMENTS

| | | | | |
|---|---|---|---|---|
| CN | 107185125 | A * | 9/2017 | |
| EP | 0807451 | A2 | 11/1997 | |
| EP | 2119478 | A1 * | 11/2009 | A62B 35/0031 |
| JP | 201580578 | A | 4/2015 | |
| WO | 2005025677 | A1 | 3/2005 | |
| WO | WO-2021099940 | A1 * | 5/2021 | A62B 35/00 |

* cited by examiner

VIEW V-V

DETAIL A

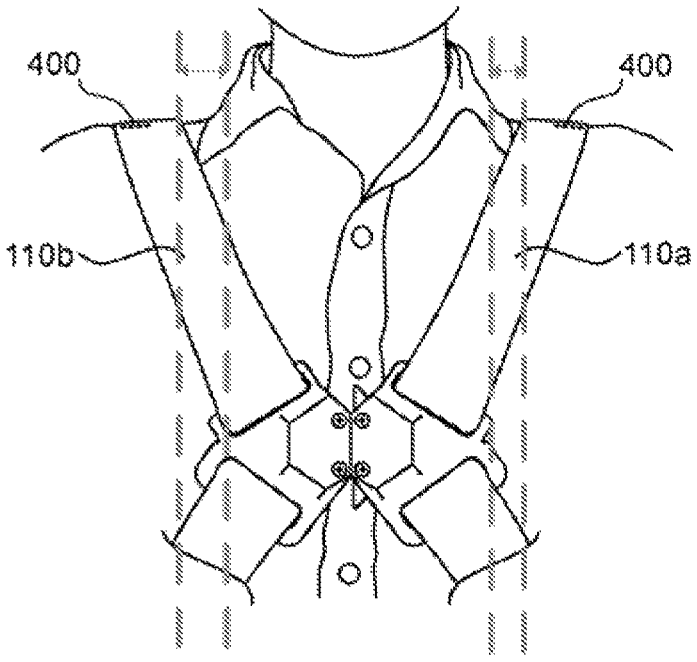
FIG. 10A
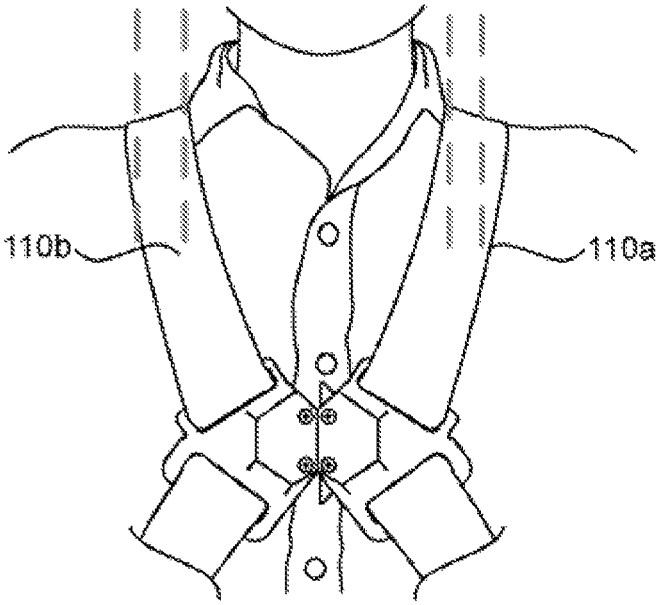
FIG. 10B - Prior Art

HARNESS BACK PLATE AND STRAP ARRANGEMENT

CROSS-REFERENCE TO RELATED APPLICATION

The present application claims priority to U.S. Provisional Application No. 62/745,034, filed Oct. 12, 2018, the disclosure of which is incorporated herein in its entirety.

BACKGROUND

Technical Field

The present disclosure relates generally to wearable body harnesses and, in particular, to a harness back plate and strap arrangement of a wearable body harness.

Technical Description

As is known in the art, there exist various safety devices and arrangements that can be worn by or attached to a user to ensure the wearer's safety in certain situations. Such mechanisms come in many forms, including, but not limited to, harnesses and safety belts. Full body harnesses are widely used for lifting and lowering individuals in dangerous situations and as a primary component in a personal fall arrest system. These harnesses can also be used for work positioning, travel restriction, ladder climbing, rescue retrieval, and evacuation. While these harnesses are used mainly in an industrial setting, and particularly the construction industry where the likelihood and danger of falls from heights is both numerous and significant, a full body harness can be used in various other applications in which total suspension and support of the body must be ensured, either expectedly or unexpectedly.

While there are many variations in full body harness construction, all typically include a plurality of elongate straps that are combined to fit around a user's body. In some embodiments or aspects, a full body harness may have an attachment point (D-ring) typically positioned in a central portion of the user's back or chest, and a plurality of straps routed around predetermined portions of the user's body in such a manner as to hold or suspend the user in the event of a fall.

While a variety of full body harnesses exist in the art, there is a continued need in the art for improved harnesses. Elongated straps naturally curl at angles which frequently cause discomfort to the user and create difficulty in adjusting the straps. There is also continued need in the art for improving the management of elongated straps to prevent curling.

SUMMARY

Generally, provided is an improved body harness having a harness back plate and an improved strap arrangement.

In some non-limiting embodiments or aspects, a wearable body harness may have a first shoulder strap and a second shoulder strap arranged in an X-shaped configuration and a back plate on a rear portion of the first shoulder strap and the second shoulder strap with the first shoulder strap crossing over the second shoulder strap at the back plate. The back plate may include a pair of lower guide slots, each of the lower guide slots having a first lower guide slot side and a second lower guide slot side contiguous with the first lower guide slot side and arranged at an angle relative to the first lower guide slot side and a pair of upper guide slots, each of the upper guide slots having a first upper guide slot side and a second upper guide slot side contiguous with the first upper guide slot side and arranged at an angle relative to the first upper guide slot side. A first of the pair of upper guide slots and a first of the pair of lower guide slots may be configured to route a webbing material of the first shoulder strap therethrough, and a second of the pair of upper guide slots and a second of the pair of lower guide slots may be configured to route the webbing material of the second shoulder strap therethrough.

In some non-limiting embodiments or aspects, the first upper guide slot side and the second upper guide slot side of each upper guide slot may be arranged at an acute angle relative to each other, and the first lower guide slot side and the second lower guide slot side of each lower guide slot may be arranged at an obtuse angle relative to each other. The first upper guide slot side and the second upper guide slot side of each upper guide slot may be arranged at an angle between 80° and 120° relative to each other. The first lower guide slot side and the second lower guide slot side of each lower guide slot may also be arranged at an angle between 80° and 120° relative to each other.

In some non-limiting embodiments or aspects, the first lower guide slot side of each lower guide slot may be longer than the second lower guide slot side of each lower guide slot, and the first upper guide slot side of each upper guide slot may be longer than the second upper guide slot side of each upper guide slot. The first lower guide slot side of each lower guide slot may be arranged at an angle between 0° and 30° relative to a longitudinal axis of the back plate, and the first upper guide slot side of each upper guide slot may be arranged at an angle between 0° and 30° relative to a longitudinal axis of the back plate. The upper guide slots and the lower guide slots may be configured to bend the webbing material of the first and second shoulder straps in a manner so as to prevent bunching of the webbing material. The back plate may have a core and a pair of branches extending from the core in opposite directions relative to a longitudinal axis of the back plate. Each branch may extend at an angle between 40° and 65° relative to the longitudinal axis of the back plate.

In some non-limiting embodiments or aspects, the back plate may further include at least a pair of tabs protruding from a body of the back plate, each of the tabs having a first end connected to the body and a second free end, and the tabs may be spaced apart from each other to define a recess therebetween. At least one of the tabs may have a projection at the second end, and the projection may be spaced apart and substantially parallel or arranged at an acute angle relative to the body of the back plate. The at least a pair of tabs may also be deflectable relative to the body of the back plate.

In some non-limiting embodiments or aspects, a back plate for routing a pair of shoulder straps of a body harness may include a body including a core and a pair of branches extending from the core in opposite directions relative to a longitudinal axis of the body, a pair of lower guide slots extending through the core, each of the lower guide slots having a first lower guide slot side and a second lower guide slot side contiguous with the first lower guide slot side and arranged at an angle relative to the first lower guide slot side, and a pair of upper guide slots extending through the pair of branches, each of the upper guide slots having a first upper guide slot side and a second upper guide slot side contiguous with the first upper guide slot side and arranged at an angle relative to the first upper guide slot side. A first of the pair of upper guide slots and a first of the pair of lower guide slots may be configured to route a webbing material of a first shoulder strap therethrough, and a second of the pair of upper guide slots and a second of the pair of lower guide slots are configured to route the webbing material of a second shoulder strap therethrough.

In some non-limiting embodiments or aspects, the first upper guide slot side and the second upper guide slot side of each upper guide slot may be arranged at an acute angle relative to each other, and the first lower guide slot side and the second lower guide slot side of each lower guide slot may be arranged at an obtuse angle relative to each other. The first upper guide slot side and the second upper guide slot side of each upper guide slot may be arranged at an angle between 80° and 120° relative to each other, and the first lower guide slot side and the second lower guide slot side of each lower guide slot may be arranged at an angle between 80° and 120° relative to each other. The first upper guide slot side of each upper guide slot may be longer than the second upper guide slot side, and the first lower guide slot side of each lower guide slot may be longer than the second lower guide slot side. The upper guide slots and the lower guide slots may be configured to bend the webbing material of the first and second shoulder straps in a manner so as to prevent bunching of the webbing material.

Further non-limiting embodiments or aspects are set forth in the following numbered clauses.

Clause 1: A wearable body harness comprising: a first shoulder strap and a second shoulder strap arranged in an X-shaped configuration; and a back plate on a rear portion of the first shoulder strap and the second shoulder strap with the first shoulder strap crossing over the second shoulder strap at the back plate, the back plate comprising: a pair of lower guide slots, each of the lower guide slots having a first lower guide slot side and a second lower guide slot side contiguous with the first lower guide slot side and arranged at an angle relative to the first lower guide slot side; and a pair of upper guide slots, each of the upper guide slots having a first upper guide slot side and a second upper guide slot side contiguous with the first upper guide slot side and arranged at an angle relative to the first upper guide slot side, wherein a first of the pair of upper guide slots and a first of the pair of lower guide slots are configured to route a webbing material of the first shoulder strap therethrough, and wherein a second of the pair of upper guide slots and a second of the pair of lower guide slots are configured to route the webbing material of the second shoulder strap therethrough.

Clause 2: The wearable body harness of clause 1, wherein the first upper guide slot side and the second upper guide slot side of each upper guide slot are arranged at an acute angle relative to each other, and wherein the first lower guide slot side and the second lower guide slot side of each lower guide slot are arranged at an obtuse angle relative to each other.

Clause 3: The wearable body harness of clause 1 or 2, wherein the first upper guide slot side and the second upper guide slot side of each upper guide slot are arranged at an angle between 80° and 120° relative to each other.

Clause 4: The wearable body harness of any of clauses 1-3, wherein the first lower guide slot side and the second lower guide slot side of each lower guide slot are arranged at an angle between 80° and 120° relative to each other.

Clause 5: The wearable body harness of any of clauses 1-4, wherein the first lower guide slot side of each lower guide slot is longer than the second lower guide slot side of each lower guide slot.

Clause 6: The wearable body harness of any of clauses 1-5, wherein the first upper guide slot side of each upper guide slot is longer than the second upper guide slot side of each upper guide slot.

Clause 7: The wearable body harness of any of clauses 1-6, wherein the first lower guide slot side of each lower guide slot is arranged at an angle between 0° and 30° relative to a longitudinal axis of the back plate.

Clause 8: The wearable body harness of any of clauses 1-7, wherein the first upper guide slot side of each upper guide slot is arranged at an angle between 0° and 30° relative to a longitudinal axis of the back plate.

Clause 9: The wearable body harness of any of clauses 1-8, wherein the upper guide slots and the lower guide slots are configured to bend the webbing material of the first and second shoulder straps in a manner so as to prevent bunching of the webbing material.

Clause 10: The wearable body harness of any of clauses 1-9, wherein the back plate has a core and a pair of branches extending from the core in opposite directions relative to a longitudinal axis of the back plate.

Clause 11: The wearable body harness of any of clauses 1-10, wherein each branch extends at an angle between 40° and 65° relative to the longitudinal axis of the back plate.

Clause 12: The wearable body harness of any of clauses 1-11, wherein the back plate further comprises at least a pair of tabs protruding from a body of the back plate, each of the tabs having a first end connected to the body and a second free end, and wherein the tabs are spaced apart from each other to define a recess therebetween.

Clause 13: The wearable body harness of any of clauses 1-12, wherein at least one of the tabs has a projection at the second end, and wherein the projection is spaced apart and substantially parallel or arranged at an acute angle relative to the body of the back plate.

Clause 14: The wearable body harness of any of clauses 1-13, wherein the at least a pair of tabs are deflectable relative to the body of the back plate.

Clause 15: A back plate for routing a pair of shoulder straps of a body harness, the back plate comprising: a body comprising a core and a pair of branches extending from the core in opposite directions relative to a longitudinal axis of the body; a pair of lower guide slots extending through the core, each of the lower guide slots having a first lower guide slot side and a second lower guide slot side contiguous with the first lower guide slot side and arranged at an angle relative to the first lower guide slot side; and a pair of upper guide slots extending through the pair of branches, each of the upper guide slots having a first upper guide slot side and a second upper guide slot side contiguous with the first upper guide slot side and arranged at an angle relative to the first upper guide slot side, wherein a first of the pair of upper guide slots and a first of the pair of lower guide slots are configured to route a webbing material of a first shoulder strap therethrough, and wherein a second of the pair of upper guide slots and a second of the pair of lower guide slots are configured to route the webbing material of a second shoulder strap therethrough.

Clause 16: The back plate of clause 15, wherein the first upper guide slot side and the second upper guide slot side of each upper guide slot are arranged at an acute angle relative to each other, and wherein the first lower guide slot side and the second lower guide slot side of each lower guide slot are arranged at an obtuse angle relative to each other.

Clause 17: The back plate of clause 15 or 16, wherein the first upper guide slot side and the second upper guide slot side of each upper guide slot are arranged at an angle between 80° and 120° relative to each other, and wherein the first lower guide slot side and the second lower guide slot side of each lower guide slot are arranged at an angle between 80° and 120° relative to each other.

Clause 18: The back plate of any of clauses 15-17, wherein the first upper guide slot side of each upper guide slot is longer than the second upper guide slot side, and wherein the first lower guide slot side of each lower guide slot is longer than the second lower guide slot side.

Clause 19: The back plate of any of clauses 15-18, wherein the upper guide slots and the lower guide slots are configured to bend the webbing material of the first and second shoulder straps in a manner so as to prevent bunching of the webbing material.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

FIG. 10A is a front view of the user wearing the harness having the shoulder straps shown in FIG. 9A; and FIG. 10B is a front view of a prior art harness without the shoulder straps shown in FIG. 9A. In FIGS. 1-10B, like characters refer to the same components and elements, as the case may be, unless otherwise stated.

DETAILED DESCRIPTION

Figure 1:
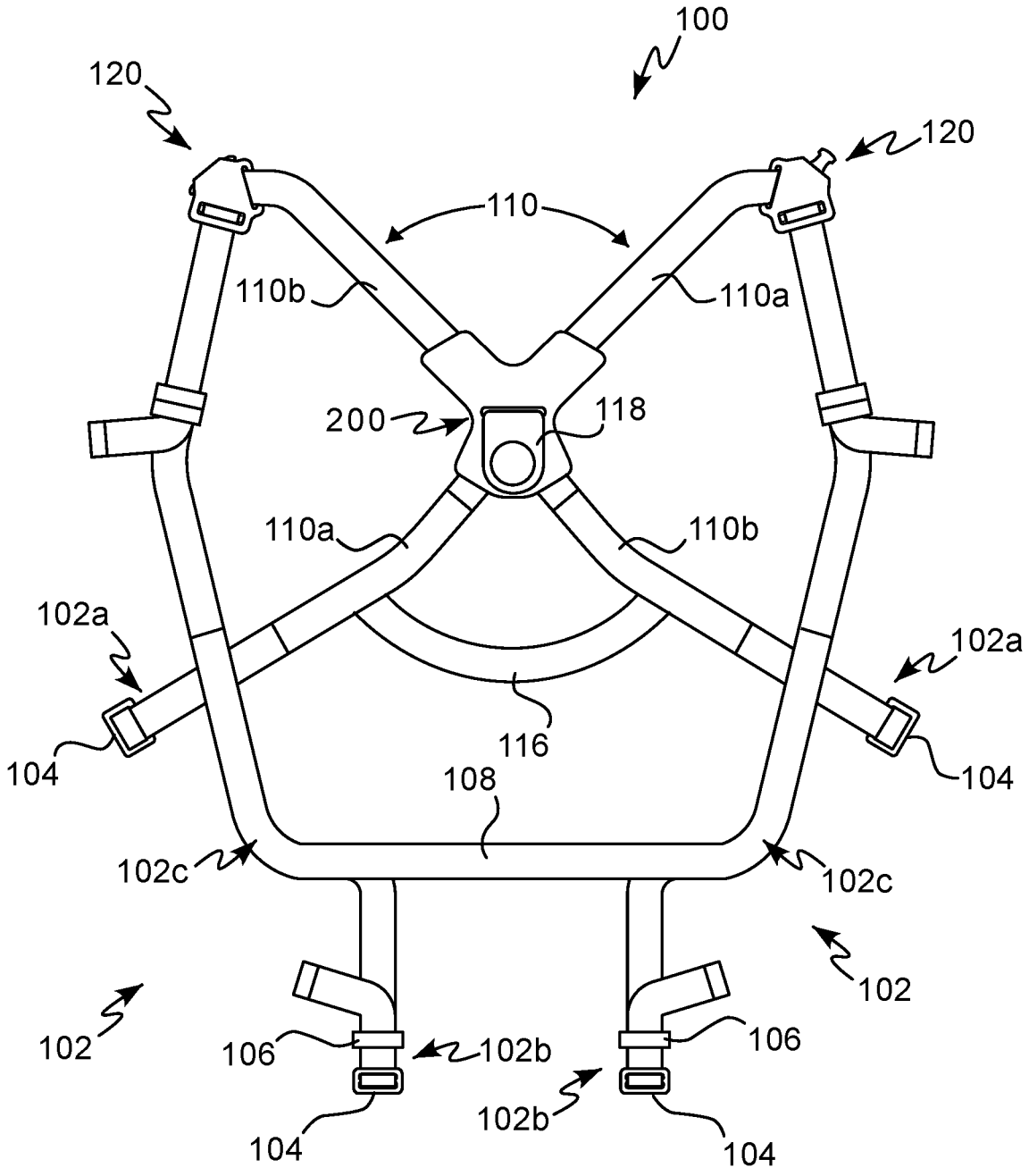
FIG. 1 is a rear view of a wearable body harness in accordance with some non-limiting embodiments or aspects of the present disclosure.

As used herein, the singular forms of "a", "an", and "the" include plural referents unless the context clearly dictates otherwise.

Spatial or directional terms, such as "left", "right", "inner", "outer", "above", "below", and the like, relate to the disclosure as shown in the drawing figures and are not to be considered as limiting, as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of the disclosure may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the disclosure.

In some non-limiting embodiments or aspects, and with reference to FIG. 1, the present disclosure is directed to a safety harness 100 (hereinafter referred to as "harness 100") used in a fall protection system. The harness 100 has a plurality of straps that are arranged to support the user's body in an event of a fall. The harness 100 has a harness connection arrangement configured for releasably coupling at least a pair of straps of the harness 100.

With continued reference to FIG. 1, the harness 100 has at least two leg straps 102 configured to attach around a user's legs below a user's groin area. When attached, the leg straps 102 loop around or encircle each of the user's legs. Each leg strap 102 has a first end 102*a* that is removably attachable to a second end 102*b* via a connector 104 that permits removable attachment of the first end 102*a* to the second end 102*b* of each leg strap 102. In some non-limiting embodiments or aspects, the at least one connector 104 and/or the leg strap 102 may have at least one adjustment mechanism 106 configured for adjusting the length of each leg strap 102. As shown in FIG. 1, the adjustment mechanism 106 is connected to the second end 102*b*, but the adjustment mechanism 106 may instead be connected to the first end 102*a*. Each leg strap 102 is connected to a seat strap 108 at an intermediate portion 102*c* of the leg strap 102 between the first end 102*a* and the second end 102*b*. The seat strap 108 may extend across a user's lower back, buttocks, or an upper portion of the leg when the harness 100 is in use, depending on the user's size. Each leg strap 102 may be formed from a substantially flat webbing material typically used in harness construction, such as rayon, polyester, nylon or other materials known to those having skill in the art.

When applying a leg strap 102 to a leg of a user, the intermediate portion 102*c* may wrap around the back of a user's leg at or below the buttocks. The first end 102*a* and the second end 102*b* may wrap around the front of a user's leg and connect at a point on the user's thigh by way of the connector 104. The adjustment mechanism 106 can then be used to adjust the length of the leg strap 102 and increase or decrease the tightness of the leg strap 102 around the user's leg. It is contemplated that the connector 104 may be any suitable connector known to those having skill in the art. For example, the connector 104 may be a buckle-type or a belt-type connector. It is further contemplated that the adjustment mechanism 106 may be any suitable adjustment mechanism known to those having skill in the art. For example, the adjustment mechanism 106 may be a sliding adjustment buckle.

With continued reference to FIG. 1, the harness 100 further has a pair of shoulder straps 110 configured to extend over at least a portion of the user's shoulders. The shoulder straps 110 may have a first shoulder strap 110*a* and a second shoulder strap 110*b* arranged to overlap one another in an X-shaped configuration, with the shoulder straps 110*a*, 110*b* configured to be connected at the user's chest area via a chest connector 120. Like the connector 104, the chest connector 120 may be any suitable connector, such as a buckle, known to those having skill in the art.

In this manner, the shoulder straps 110*a*, 110*b* are configured to cross over each other at a rear portion of the harness 100 worn on the user's back. As described herein, the harness 100 may have a back plate 200 through which the first shoulder strap 110*a* and the second shoulder strap 110*b* can be routed to maintain the first shoulder strap 110*a* and the second shoulder strap 110*b* in the X-shaped configuration. The first shoulder strap 110*a* may cross a longitudinal axis of the back plate 200 and the second shoulder strap 110*b* when forming an X-shaped configuration. The second shoulder strap 110*b* may also cross the longitudinal axis of the back plate 200 as well as the first shoulder strap 110*a*. In some embodiments or aspects, neither the first shoulder strap 110*a* nor the second shoulder strap 110*b* may cross the longitudinal axis of the back plate 200 or the other shoulder strap. In other embodiments or aspects, the second shoulder strap 110*b* may not cross the longitudinal axis of the back plate 200 or the first shoulder strap 110*a*. In these embodiments, the first and second shoulder straps 110*a*, 110*b* may stay on one half of a user's body.

After the routing through the back plate 200, the shoulder straps 110*a*, 110*b* may extend downward and beyond the back plate 200 in generally opposite directions, maintaining the X-shaped configuration, until the first shoulder strap 110*a* and the second shoulder strap 110*b* reach the first ends 102*a* of the leg straps 102. The first and second shoulder straps 110*a*, 110*b* may either connect to the first ends 102*a* of the leg straps, or the first ends 102*a* of the leg straps may be a distal end of the first and second shoulder straps 110*a*, 110*b*. Like the leg straps 102, the shoulder straps 110*a*, 110*b* may be formed from a substantially flat webbing material typically used in harness construction, such as rayon, polyester, nylon or other materials known to those having skill in the art.

As further shown in FIG. 1, the harness 100 may have a back strap 116 connecting a substantially intermediate portion of the first shoulder strap 110*a* with a substantially intermediate portion of the second shoulder strap 110*b*. The back strap 116 may extend across a user's back to provide support and to maintain a set distance between the first shoulder strap 110*a* and the second shoulder strap 110*b* as they extend beyond the back plate 200 and down and along a user's back. The first and second shoulder straps 110*a*, 110*b* may be connectable together at a front portion of the harness 100 in an area of the user's chest. In some non-limiting embodiments or aspects, the first and second shoulder straps 110*a*, 110*b* may have at least one connection arrangement 120 or chest connector, such as a buckle, configured to releasably connect the first and second shoulder straps 110*a*, 110*b* to each other.

As further shown in FIG. 1, the harness 100 has an anchor element, such as a D-ring 118, for connecting at least a portion of the shoulder straps 110*a*, 110*b* to a line fixed to an attachment, anchor point, or to a personal fall limiter device. The D-ring 118 has a frame defining at least one opening through which a clip, such as a carabiner, a lanyard, or other rope or line, can be secured to connect the harness 100 to the line or the personal fall limiter device.

Figure 2:
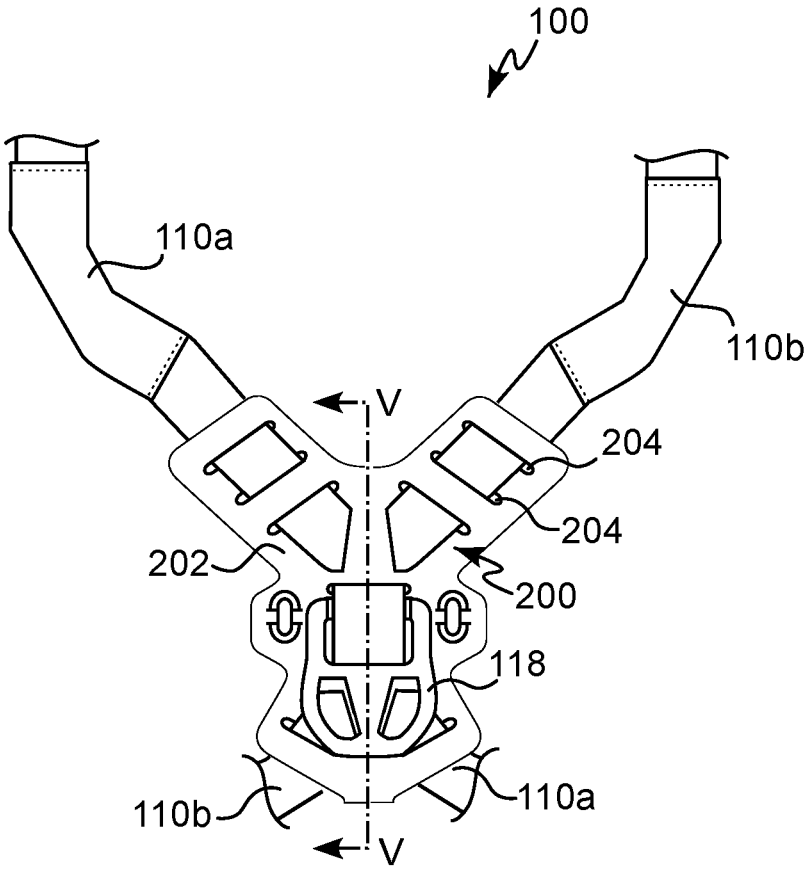
FIG. 2 is a rear view of a portion of a wearable body harness showing a harness back plate in accordance with some non-limiting embodiments or aspects of the present disclosure.

With reference to FIG. 2, a detailed rear view of a portion of the harness 100 shows the back plate 200 in accordance with some non-limiting embodiments or aspects of the present disclosure. The back plate 200 is configured to route the first and second shoulder straps 110*a*, 110*b* across one another such that the first and second shoulder straps 110*a*, 110*b* have an X-shaped configuration. The back plate 200 has a body 202 having a plurality of openings 204 configured for routing at least a portion of the first and second shoulder straps 110*a*, 110*b* through the back plate 200. The back plate 200 has the D-ring 118 connected thereto in a manner such that the first and second shoulder straps 110*a*, 110*b* are routed to prevent removal of the D-ring 118 from the back plate 200. The D-ring 118 may be connected to a personal fall limiter (PFL) 124 or a lanyard to allow the back plate 200 and harness 100 to be connected to a fixed anchor point.

As shown in FIG. 2, the shoulder straps 110*a*, 110*b* are routed through similar pathways through the openings 204 of the back plate 200. The first and second shoulder straps 110*a*, 110*b* are routed through the back plate 200 by weaving through a plurality of pathways defined by the openings 204. These pathways keep the shoulder straps 110*a*, 110*b* neatly organized across the back plate 200 and prevent undesirable tangling or bunching of the shoulder straps 110*a*, 110*b* across a user's back.

Figure 3:
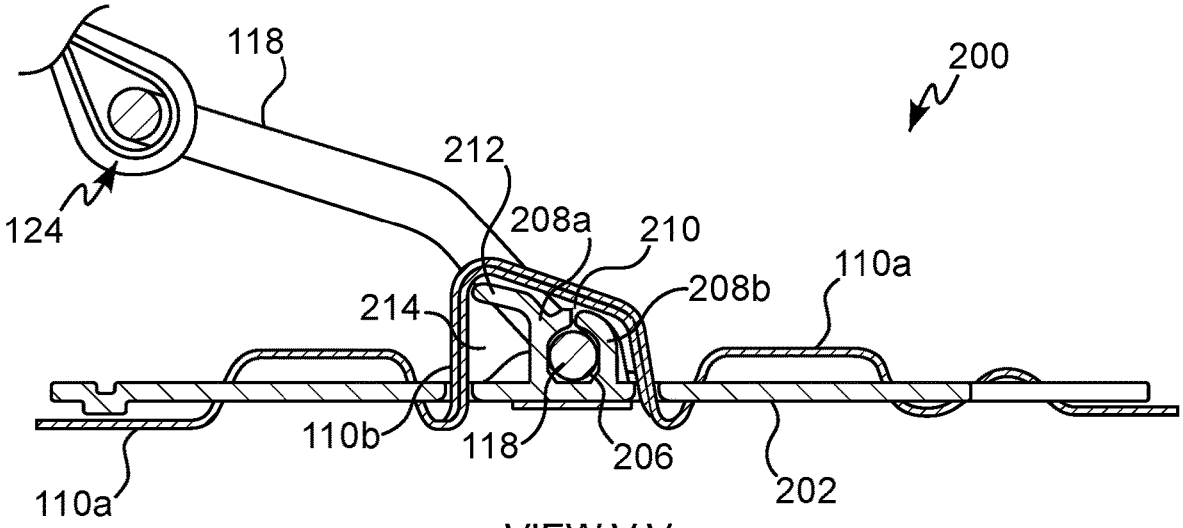
FIG. 3 is a side cross-sectional view of the harness and harness back plate shown in FIG. 2 taken along line V-V.
Figure 4A:
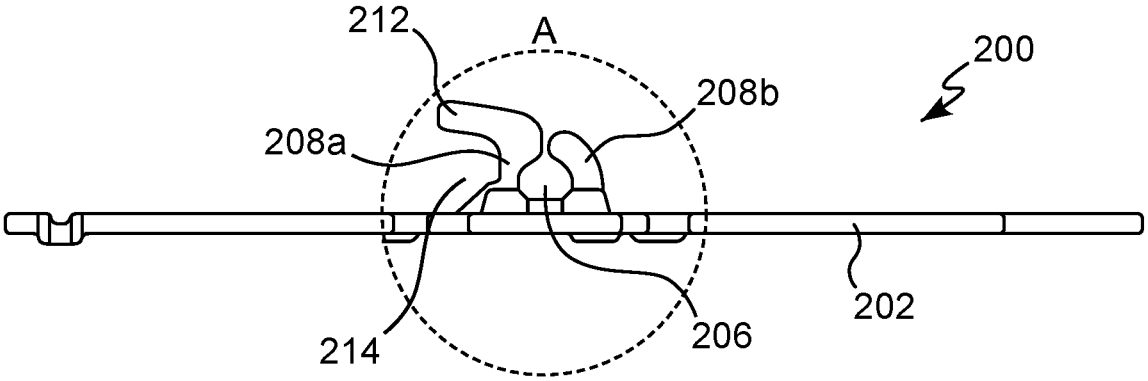
FIG. 4A a side view of the harness and harness back plate shown in FIG. 2.
Figure 4B:
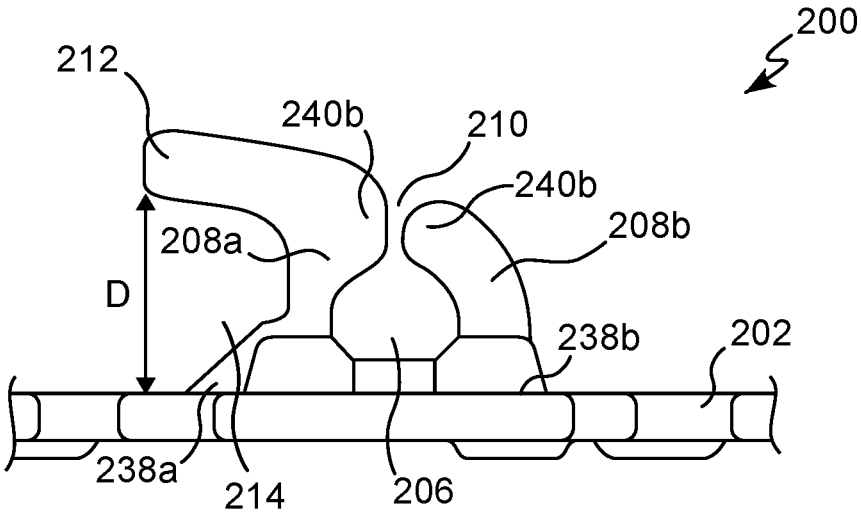
FIG. 4B an enlarged view of Detail A shown in FIG. 4A.

With reference to FIGS. 3-4B, the body 202 of the back plate 200 has a recess 206. The recess 206 may be defined between a pair of tabs 208*a*, 208*b* protruding from the body 202 and may be used for receiving at least a portion of the D-ring 118 or other attachment. The recess 206 is positioned between the lower guide slots 224*a*, 224*b* and the upper guide slots 226*a*, 226*b* (shown in FIG. 6A). As shown in FIG. 4B, each of the tabs 208*a*, 208*b* has a first end 238*a*, 238*b* connected to the body 202 of the back plate 200 and a second, free end 240*a*, 240*b* opposite the first end. The second ends 240*a*, 240*b* of the tabs 208*a*, 208*b* are arranged opposite one another with the space 210 defined therebetween. In some embodiments or aspects, the tabs 208*a*, 208*b* may be non-removably connected to the body 202 of the back plate 200. For example, the tabs 208*a*, 208*b* may be monolithically formed with the body 202, such as by being molded with the body 202 as a single piece so that first ends 238*a*, 238*b* are integral with the body 202. In other embodiments or aspects, the tabs 208*a*, 208*b* are formed as a separate component from the body 202 and are removably or non-removably connected to the body 202.

The tabs 208*a*, 208*b* may be deflectable to widen the space 210 and allow insertion of the D-ring 118 into the recess 206. As shown in FIG. 3, the first and second shoulder straps 110*a*, 110*b* are routed over the tabs 208*a*, 208*b* to prevent removal of the D-ring 118 from the recess 206 through the space 210.

Figure 5A:
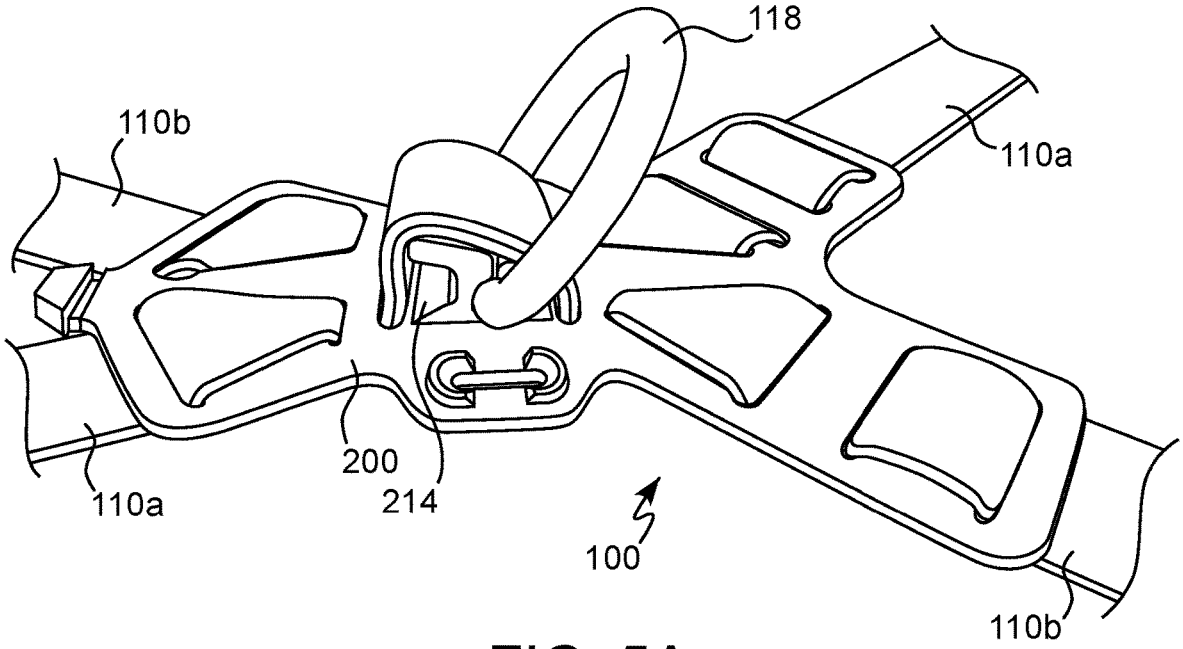
FIG. 5A is a perspective view of the harness and harness back plate shown in FIG. 2.
Figure 5B:
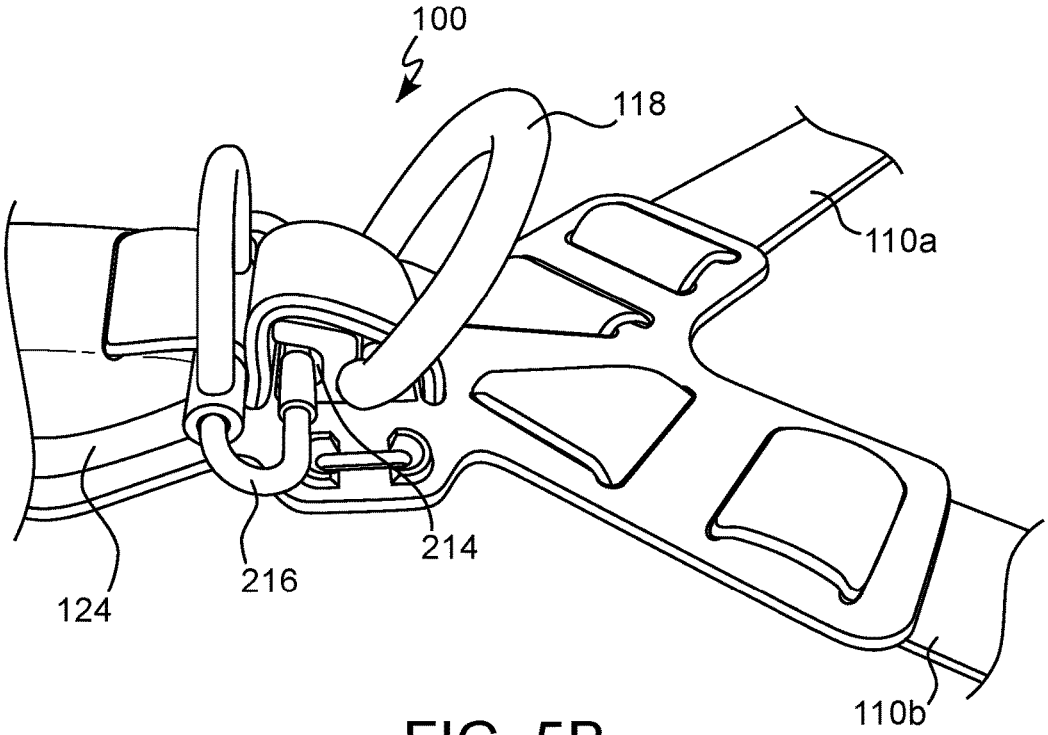
FIG. 5B is a perspective view of the harness and harness back plate shown in FIG. 2 along with a connector and a personal fall limiter device.

At least one of the tabs 208*a*, 208*b*, such as the first tab 208*a*, has a projection 212 that is spaced apart from the body 202 of the back plate 200 by a distance D. Distance D is configured to be larger than a width of a connector 216 (shown in FIG. 5B) used for connecting the PFL 124 to the harness 100. As discussed herein, the projection 212 may be arranged substantially parallel with the body 202. In other embodiments or aspects, the projection 212 is arranged at an obtuse or an acute angle relative to the body 202.

As shown in FIG. 3, the projection 212 spaces the first and second shoulder straps 110*a*, 110*b* from the first tab 208*a* such that a clearance space 214 is formed between the first and second shoulder straps 110*a*, 110*b* and the first tab 208*a*. The clearance space 214 is configured to receive the connector 216, which is shown as a carabiner in FIG. 4B.

Figure 6A:
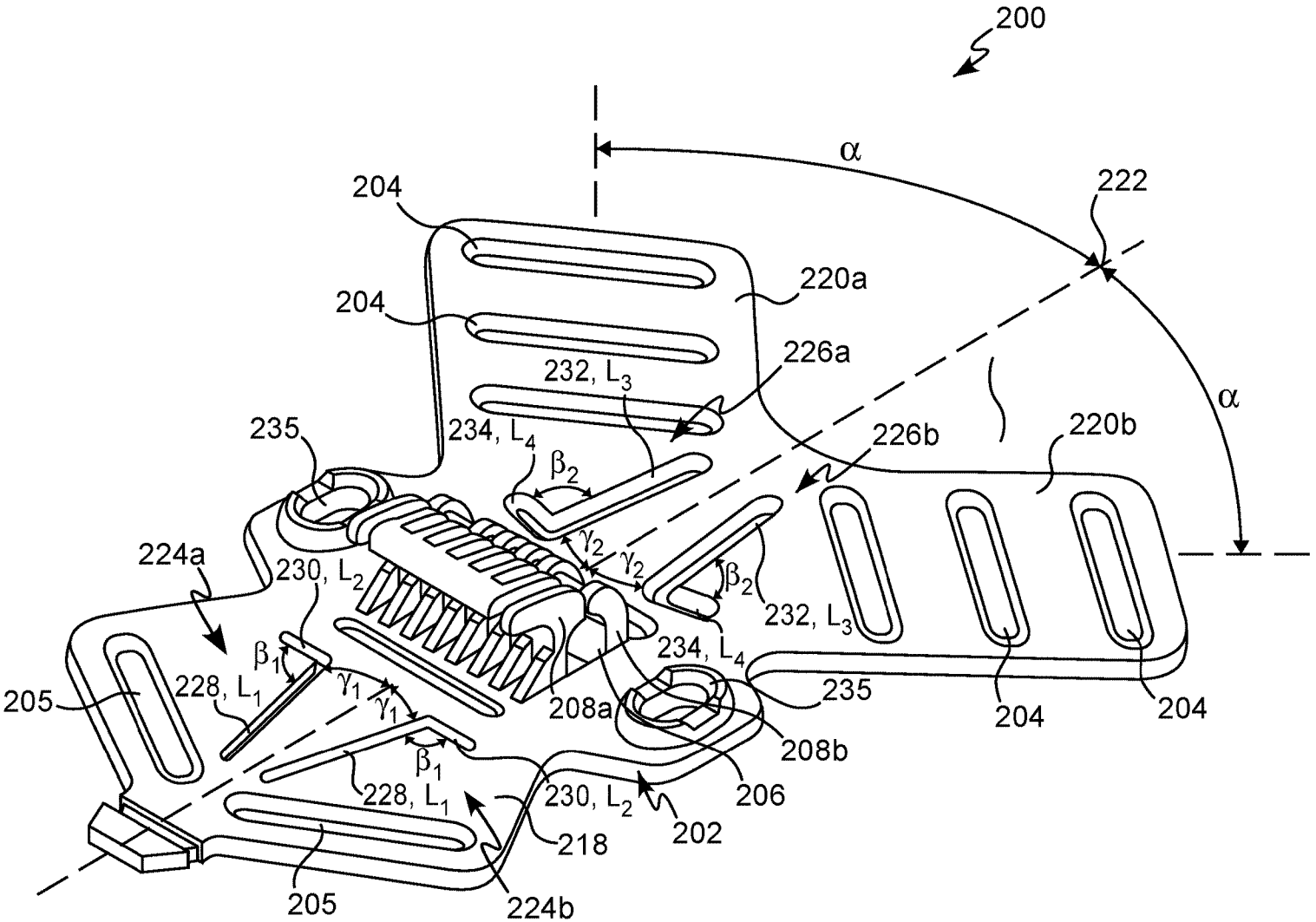
FIG. 6A is a perspective view of a harness back plate configured for use with a wearable body harness shown in accordance with some non-limiting embodiments or aspects of the present disclosure.
Figure 6B:
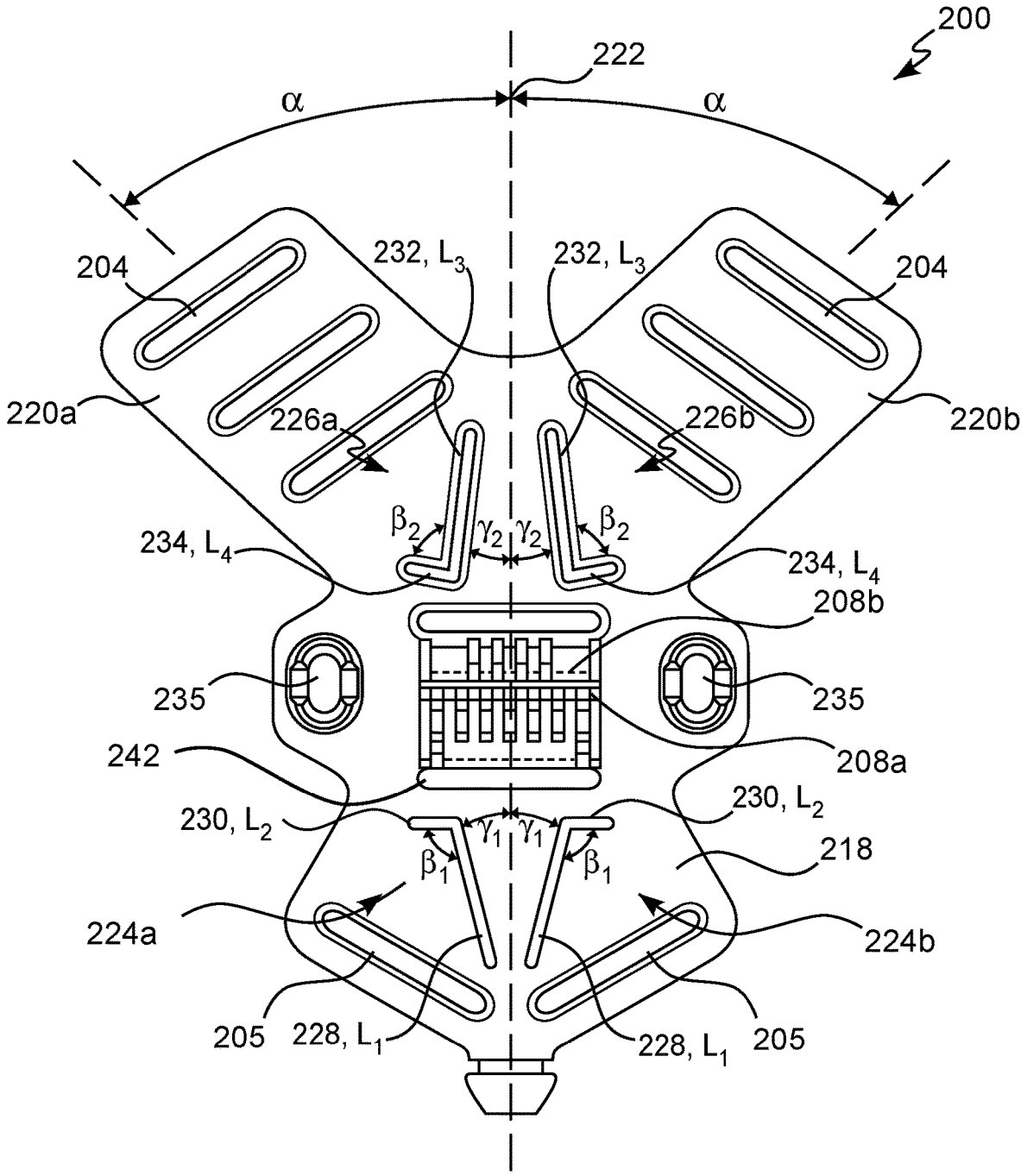
FIG. 6B is a top view of the harness back plate shown in FIG. 6A.
Figure 6C:
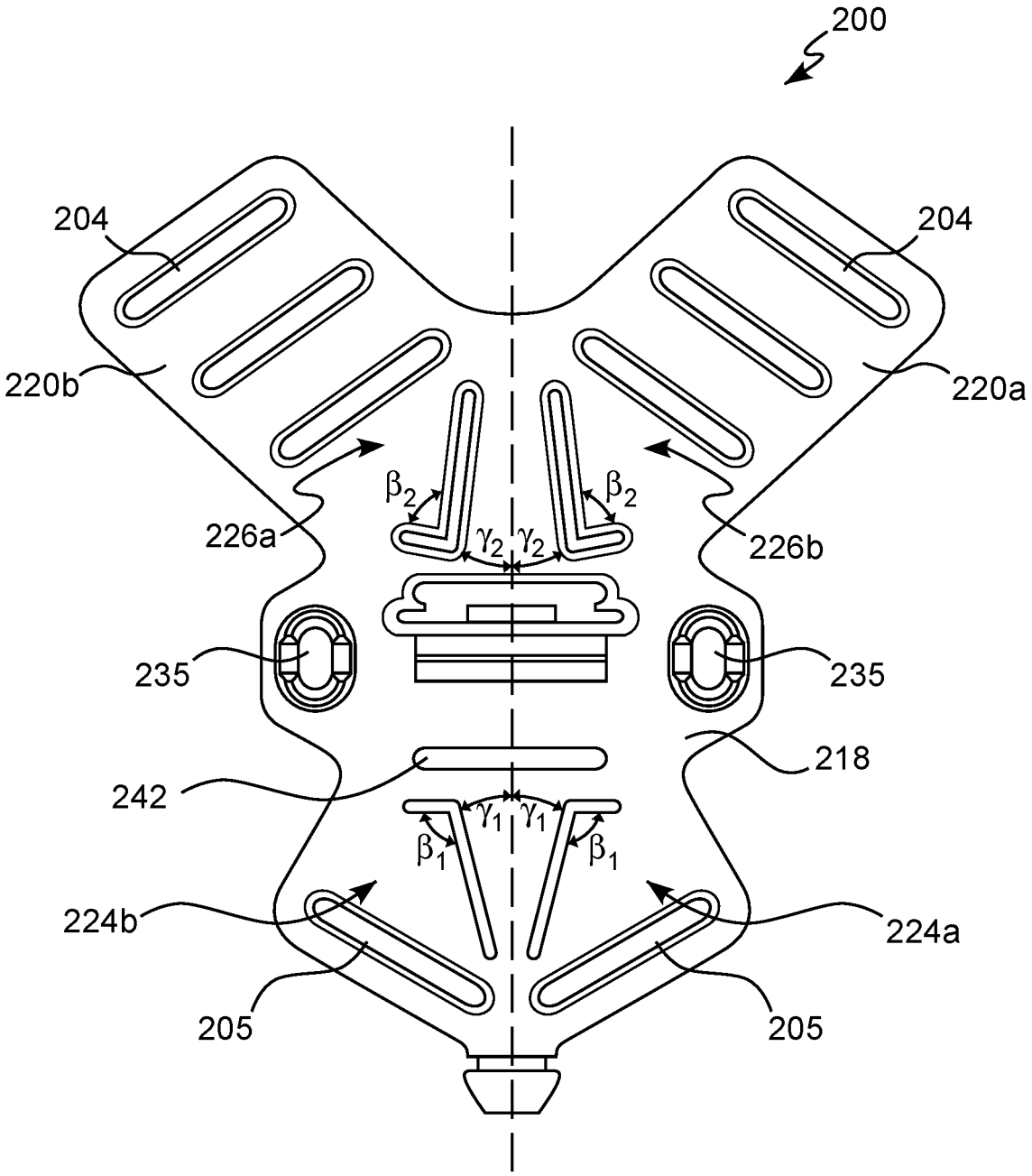
FIG. 6C is a bottom view of the harness back plate shown in FIG. 6A.

With reference to FIGS. 6A-6C, the back plate 200 is shown without the first and second shoulder straps 110*a*, 110*b*. The back plate 200 has a generally Y-shaped configuration with a core 218 and a pair of branches 220*a*, 220*b* branching away from the core 218. In use, the back plate 200 is arranged such that the branches 220*a*, 220*b* are pointed in an upward direction when worn by the user. In some embodiments or aspects, the branches 220*a*, 220*b* are arranged at an angle $\alpha$ relative to a central longitudinal axis 222 of the back plate 200. Angle $\alpha$ may be between 40° and 65°. It is contemplated that angle $\alpha$ may be outside of the 40-65° range so long as the first and second shoulder straps 110*a*, 110*b* remain aligned over a user's shoulders during use.

Each of the branches 220*a*, 220*b* has the plurality of upper openings 204 formed as elongated slots extending through the body 202 of the back plate 200. Similarly, the core 218 has a pair of lower openings 205 at its lower end for receiving the first and second shoulder straps 110*a*, 110*b*. The lower openings 205 are configured for routing at least a portion of the first and second shoulder straps 110*a*, 110*b* through the back plate 200 such that the first and second shoulder straps 110*a*, 110*b* are arranged in a direction extending from the central longitudinal axis 222 to an angle similar to angle $\alpha$. In other words, the first and second shoulder straps 110*a*, 110*b* are arranged from the branches 220*a*, 220*b* in a direction generally extending along the user's spine and then toward the user's waist in a direction as dictated by the lower openings 205.

Due to the angle of the branches 220*a*, 220*b* relative to the longitudinal axis 222 and the core 218, the first and second shoulder straps 110*a*, 110*b* are bent in directions that may cause the webbing of the straps to curl, bunch up, or pucker. In order to eliminate such curling, bunching, or puckering of the webbing of the first and second shoulder straps 110*a*, 110*b*, the back plate 200 has a pair of lower guide slots 224*a*, 224*b* extending through the core 218 and a pair of upper guide slots 226*a*, 226*b* extending through the branches 220*a*, 220*b*. The lower and upper guide slots 224*a*, 224*b*, 226*a*, 226*b* are configured to receive first and second shoulder straps 110*a*, 110*b* and to facilitate bending of the webbing of the first and second shoulder straps 110*a*, 110*b* in a manner to prevent the bunching or puckering of the webbing material. This arrangement of guide slots 224*a*, 224*b*, 226*a*, 226*b* manages to keep the first and second shoulder straps 110*a*, 110*b* smooth when traversing along the back plate 200 and along a user's body.

With continued reference to FIGS. 6A-6C, the lower guide slots 224*a*, 224*b* are positioned below the tabs 208*a*, 208*b* defining the recess 206. A first lower guide slot 224*a* is configured to receive the first shoulder strap 110*a*, while the second lower guide slot 224*b* is configured to receive the second shoulder strap 110*b*. Each of the lower guide slots 224*a*, 224*b* has a first side 228 having a first length $L_1$ and a second side 230 having a second length $L_2$. The first and second sides 228, 230 are connected to each other and arranged to form a substantially L-shaped arrangement. In some embodiments or aspects, the first length $L_1$ may be longer than the second length $L_2$. In other embodiments or aspects, the first length $L_1$ may be equal to or shorter than the second length $L_2$. The first side 228 and the second side 230 define an angle $\beta_1$ therebetween. In some embodiments or aspects, the angle $\beta_1$ may be between 80° and 120°. It is contemplated that the angle $\beta_1$ may be outside of the 80-120° range so long as the first and second shoulder straps 110*a*, 110*b* can be routed through the back plate 200 without puckering of the webbing material. The first sides 228 of the first and second lower guide slots 224*a*, 224*b* may be arranged at an angle $\gamma$1 relative to the longitudinal axis 222. In some embodiments or aspects, the angle $\gamma$1 may be between 0° and 30°. In some embodiments or aspects, the second side 230 may define an angle of 0° to 25° relative to a line that is perpendicular to the longitudinal axis 222. Each of the first and second sides 228, 230 has a width that is wider than a thickness of the webbing of the first and second shoulder straps 110*a*, 110*b*.

The upper guide slots 226*a*, 226*b* are positioned above the tabs 208*a*, 208*b* defining the recess 206. A first upper guide slot 226*a* is configured to receive the second shoulder strap 110*b*, while the second upper guide slot 226*b* is configured to receive the first shoulder strap 110*a*, with the first and second shoulder straps 110*a*, 110*b* overlapping and crossing over each other and between the lower guide slots 224*a*, 224*b* and the upper guide slots 226*a*, 226*b*. Each of the upper guide slots 226*a*, 226*b* has a first side 232 having a first length $L_3$ and a second side 234 having a second length $L_4$. The first and second sides 232, 234 are connected to each other and arranged to form a substantially L-shaped arrangement. In some embodiments or aspects, the first length $L_3$ may be longer than the second length $L_4$. In other embodiments or aspects, the first length $L_3$ may be equal to or shorter than the second length $L_4$. The first side 232 and the second side 234 define an angle $\beta_2$ therebetween. In some embodiments or aspects, the angle $\beta_2$ may be between 80° and 120°. The first sides 232 of the first and second upper guide slots 226*a*, 226*b* may be arranged at an angle $\gamma 2$ relative to the longitudinal axis 222. In some embodiments or aspects, the angle $\gamma 2$ may be between 0° and 30°. Each of the first and second sides 232, 234 has a width that is wider than a thickness of the webbing of the first and second shoulder straps 110*a*, 110*b*. The upper guide slots 226*a*, 226*b* may be arranged such that the second side 234 of each slot is positioned opposite the second side 230 of the lower guide slots 224*a*, 224*b*. In some embodiments, the back plate 200 may also have slots 235 for receiving other attachments therethrough.

Figure 7:
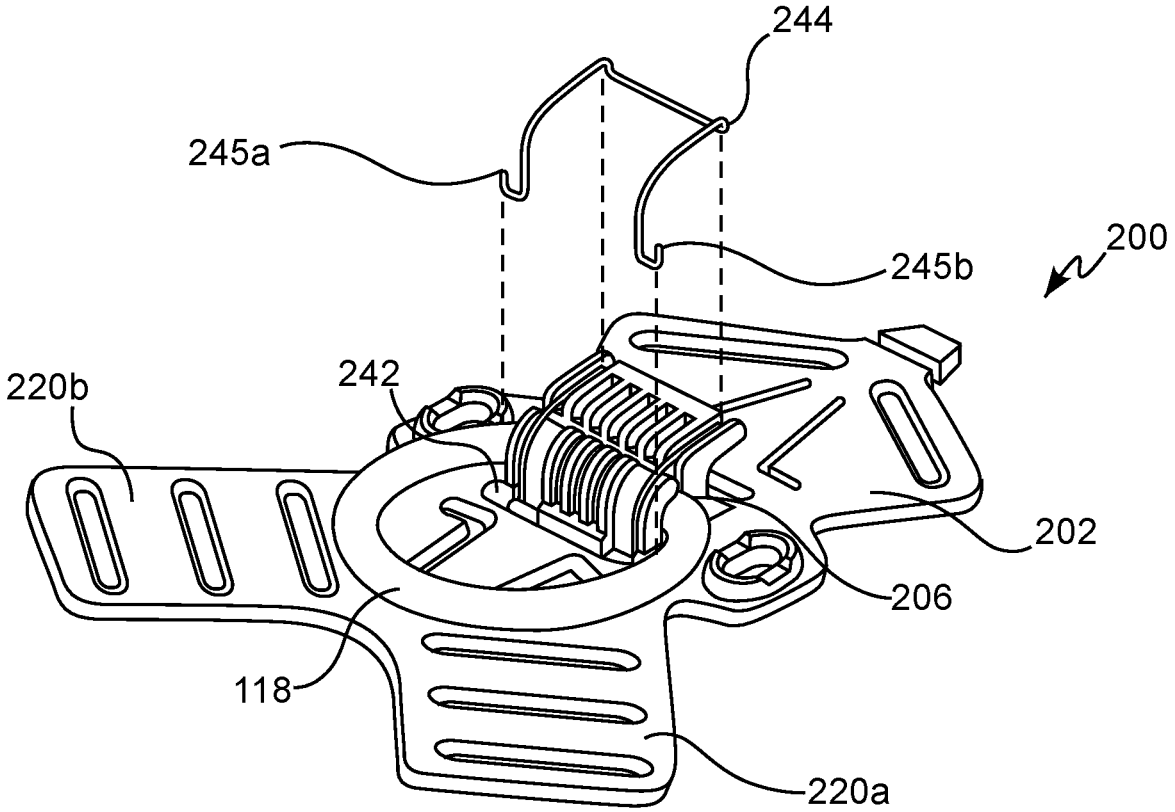
FIG. 7 is an exploded perspective view of the harness back plate shown in FIG. 6A shown in combination with a D-ring and clip.

As shown in FIG. 7, at least a portion of the back plate 200, such as the tabs 208*a*, 208*b*, may have a locking slot 242 for receiving a clip 244. The clip 244 is configured to extend over the space 210, thereby preventing removal of the D-ring 118 or similar attachment. The clip 244 has hooks 245*a*, 245*b* configured to engage with the locking slot 242, thus permitting the clip 244 to be removably connected to the locking slot 242 to permit removal of the D-ring 118 when the clip 244 is removed. The clip 244 may have hooks 245*a*, 245*b* configured to engage at least a portion of the locking slot 242 in order to remain in place over the space 210. The hooks may engage and disengage the locking slot 242 by squeezing the clip 244. This permits the clip 244 to slide into and out of the locking slot 242. When the locking clip 244 is inside the slot, the squeezing may cease allowing the hooks 245*a*, 245*b* to press against the locking slot 242 in a frictional fit. The hooks 245*a*, 245*b* may also hook around a locking peg (not shown) within the slot 242 permitting the clip 244 to be locked in place within the locking slot 242. The locking clip 244 may then be squeezed and removed in a manner opposite of its insertion in order to no longer obstruct the space 210.

Figure 8:
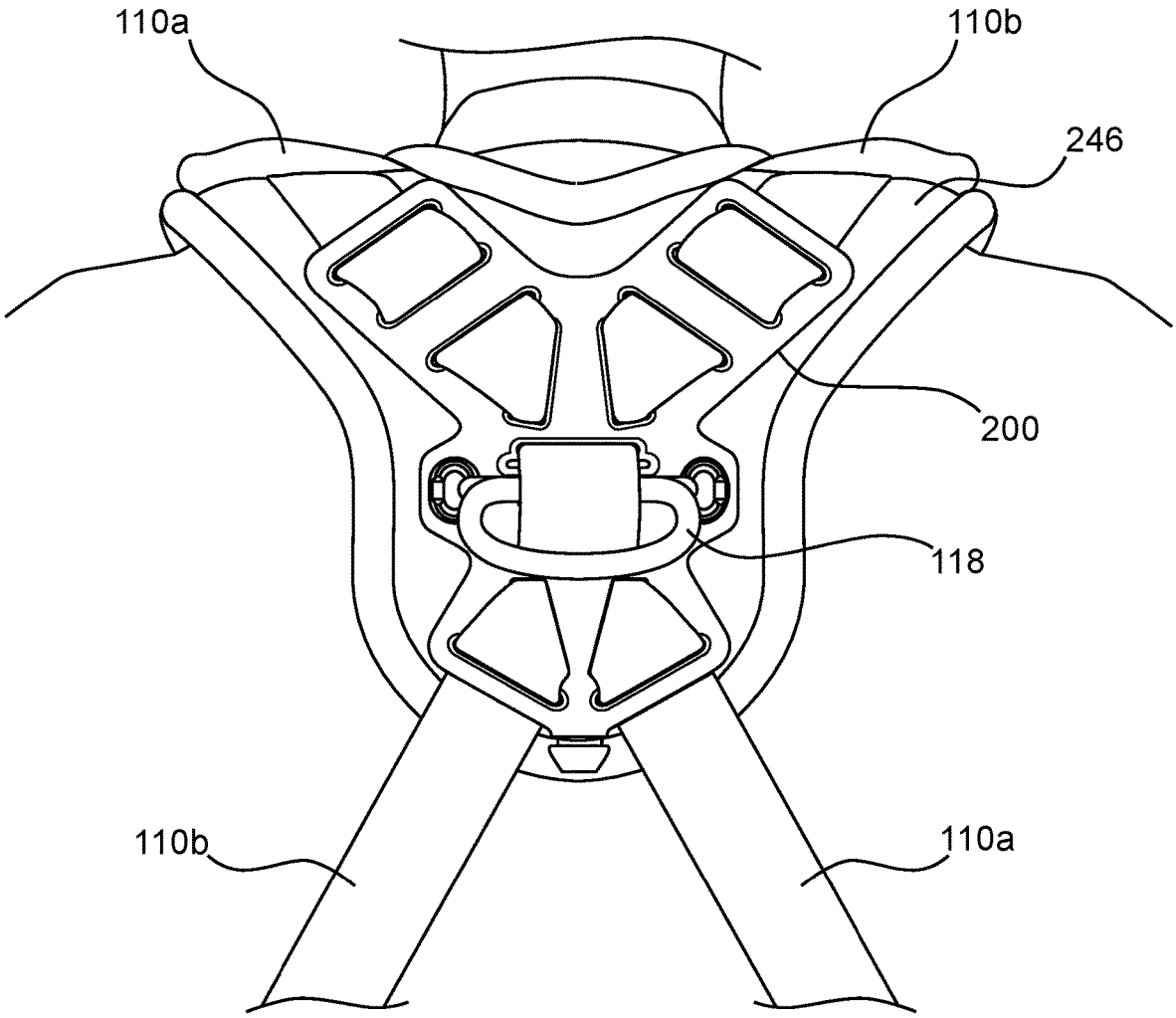
FIG. 8 is a rear view of a wearable body harness showing a harness back plate and a back pad in accordance with some non-limiting embodiments or aspects of the present disclosure.

In some non-limiting embodiments or aspects, such as shown in FIG. 8, the back plate 200 may have a back pad 246. The back pad 246 may be made from a soft material, such as padding or foam, to cushion the user's back from the back plate 200 and the first and second shoulder straps 110*a*, 110*b*. The back pad 246 is positioned between the back plate 200 and the user so as to prevent direct contact between the back plate 200 and the user. The back pad 246 may take the same generally Y-shaped configuration as the core 218 of the back plate 200. However, the back pad 246 is larger than the back plate 200 so as to prevent contact between the back plate 200 and the user if the back plate 200 shifts during use. A back pad 246 larger than the back plate 200 may also prevent part of the user's shoulders from contacting portions of the first and second shoulder straps 110*a*, 110*b*. For example, the back pad 246 may be positioned between the user's back and the first and second shoulder straps 110*a*, 110*b*.

Figure 9A:
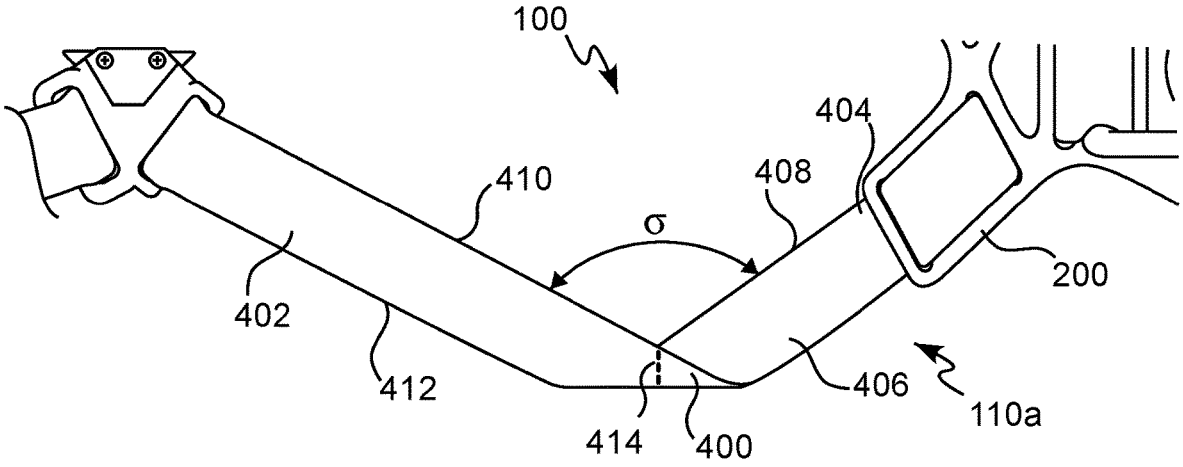
FIG. 9A is a top view of harness shoulder strap having a fold in accordance with some non-limiting embodiments or aspects of the present disclosure.
Figure 9B:
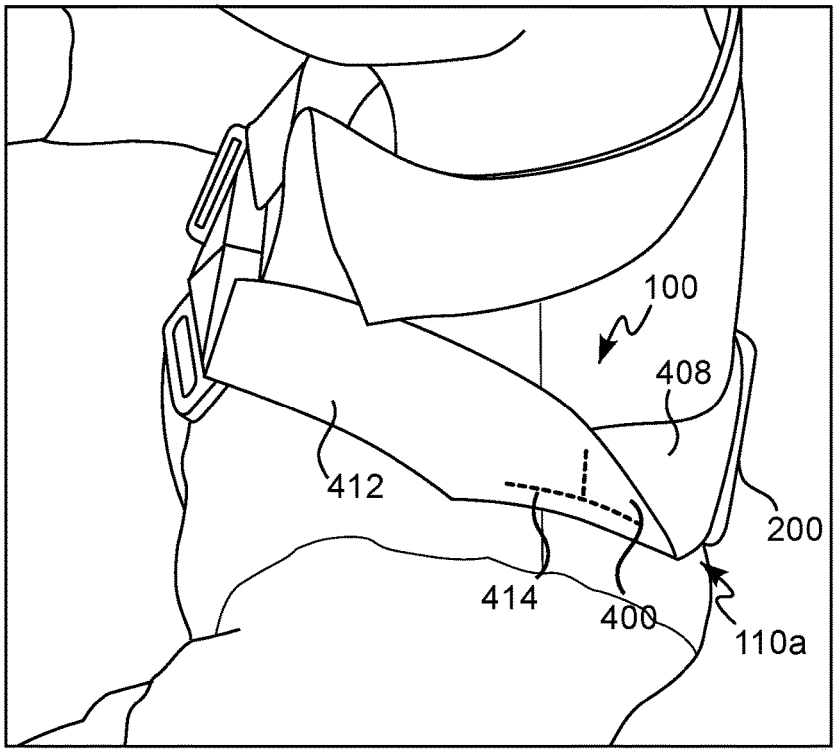
FIG. 9B is a detailed top view of a user wearing a harness having the shoulder strap shown in FIG. 9A.

With reference to FIGS. 9A and 9B, the shoulder straps 110, such as the first and second shoulder straps 110*a*, 110*b*, have a pre-formed fold 400 configured to position the first and second shoulder straps 110*a*, 110*b* away from the user's neck. Due to the flexible nature of the webbing of the first and second shoulder straps 110*a*, 110*b*, the straps 110*a*, 110*b* have a natural tendency to take a most direct path between the rear portion of the harness 100 at the back plate 200 and a front portion of the harness 100 at the connector 106, thereby interfering with the user's neck (see FIG. 10B). The pre-formed fold 400 positions the first and second shoulder straps 110*a*, 110*b* away from the user's neck (see FIG. 10A), thereby increasing the user's comfort while wearing the harness 100.

With continued reference to FIGS. 9A and 9B, wherein only the first shoulder strap 110*a* is shown for clarity of illustration, the fold 400 is formed by folding the first shoulder strap 110*a* over itself between a first end 402 and a second end 404. The first shoulder strap 110*a* has a first section 408 and a second section 412 extending in opposite directions from the fold 400 as the first shoulder strap 110*a* sits atop a user's shoulder. The fold 400 may be formed by folding the first shoulder strap 110*a* such that a top surface 406 of a first section 408 abuts a top surface 410 of a second section 412 of the first shoulder strap 110*a*. The folded sections may be stitched together by stitching 414. The stitching 414 may extend across the first shoulder strap 110*a* in the direction of the user's neck, along the first shoulder strap 110*a* in the direction of the front side and backside of the user, or, as shown in FIG. 9B, in both directions. The first section 408 and the second section 412 define an angle $\sigma$ therebetween. In some embodiments or aspects, the angle $\sigma$ may be between 110° and 155°, such as 140°. The first section 408 may have the same or different length than the second section 412. With reference to FIG. 10A, the shoulder straps 110, such as the first and second shoulder straps 110*a*, 110*b* with the pre-formed fold 400, are configured to be positioned on the user's shoulders such that pre-formed fold 400 is positioned away from the user's neck.

Although the disclosure has been described in detail for the purpose of illustration based on what are currently considered to be the most practical, preferred, and/or non-limiting embodiments or aspects, it is to be understood that such detail is solely for that purpose and that the disclosure is not limited to the disclosed embodiments or aspects, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. A wearable body harness comprising:

a first shoulder strap and a second shoulder strap arranged in an X-shaped configuration; and a back plate on a rear portion of the first shoulder strap and the second shoulder strap with the first shoulder strap crossing over the second shoulder strap at the back plate, the back plate comprising:

a pair of lower guide slots, each of the lower guide slots having a first lower guide slot side and a second lower guide slot side contiguous with the first lower guide slot side and arranged at an angle relative to the first lower guide slot side; and a pair of upper guide slots, each of the upper guide slots having a first upper guide slot side and a second upper guide slot side contiguous with the first upper guide slot side and arranged at an angle relative to the first upper guide slot side, wherein the first upper guide slot side and the second upper guide slot side of each upper guide slot are arranged at an acute angle relative to each other, wherein a first of the pair of upper guide slots and a first of the pair of lower guide slots are configured to route a webbing material of the first shoulder strap therethrough, and wherein a second of the pair of upper guide slots and a second of the pair of lower guide slots are configured to route the webbing material of the second shoulder strap therethrough.

2. The wearable body harness of claim 1, wherein the first lower guide slot side and the second lower guide slot side of each lower guide slot are arranged at an obtuse angle relative to each other.

3. The wearable body harness of claim 1, wherein the first upper guide slot side and the second upper guide slot side of each upper guide slot are arranged at an angle between 80° and 120° relative to each other.

4. The wearable body harness of claim 1, wherein the first lower guide slot side and the second lower guide slot side of each lower guide slot are arranged at an angle between 80° and 120° relative to each other.

5. The wearable body harness of claim 1, wherein the first lower guide slot side of each lower guide slot is longer than the second lower guide slot side of each lower guide slot.

6. The wearable body harness of claim 1, wherein the first upper guide slot side of each upper guide slot is longer than the second upper guide slot side of each upper guide slot.

7. The wearable body harness of claim 1, wherein the first lower guide slot side of each lower guide slot is arranged at an angle between 0° and 30° relative to a longitudinal axis of the back plate.

8. The wearable body harness of claim 1, wherein the first upper guide slot side of each upper guide slot is arranged at an angle between 0° and 30° relative to a longitudinal axis of the back plate.

9. The wearable body harness of claim 1, wherein the upper guide slots and the lower guide slots are configured to bend the webbing material of the first and second shoulder straps in a manner so as to prevent bunching of the webbing material.

10. The wearable body harness of claim 1, wherein the back plate has a core and a pair of branches extending from the core in opposite directions relative to a longitudinal axis of the back plate.

11. The wearable body harness of claim 10, wherein each branch extends at an angle between 40° and 65° relative to the longitudinal axis of the back plate.

12. The wearable body harness of claim 1, wherein the back plate further comprises at least a pair of tabs protruding from a body of the back plate, each of the tabs having a first end connected to the body and a second free end, and wherein the tabs are spaced apart from each other to define a recess therebetween.

13. The wearable body harness of claim 12, wherein at least one of the tabs has a projection at the second end, and wherein the projection is spaced apart and substantially parallel or arranged at an acute angle relative to the body of the back plate.

14. The wearable body harness of claim 12, wherein the at least a pair of tabs are deflectable relative to the body of the back plate.

15. A back plate for routing a pair of shoulder straps of a body harness, the back plate comprising:

a body comprising a core and a pair of branches extending from the core in opposite directions relative to a longitudinal axis of the body;

a pair of lower guide slots extending through the core, each of the lower guide slots having a first lower guide slot side and a second lower guide slot side contiguous with the first lower guide slot side and arranged at an angle relative to the first lower guide slot side; and a pair of upper guide slots extending through the pair of branches, each of the upper guide slots having a first upper guide slot side and a second upper guide slot side contiguous with the first upper guide slot side and arranged at an angle relative to the first upper guide slot side, wherein the first upper guide slot side and the second upper guide slot side of each upper guide slot are arranged at an acute angle relative to each other, wherein a first of the pair of upper guide slots and a first of the pair of lower guide slots are configured to route a webbing material of a first shoulder strap therethrough, and wherein a second of the pair of upper guide slots and a second of the pair of lower guide slots are configured to route the webbing material of a second shoulder strap therethrough.

16. The back plate of claim 15, wherein the first lower guide slot side and the second lower guide slot side of each lower guide slot are arranged at an obtuse angle relative to each other.

17. The back plate of claim 15, wherein the first upper guide slot side and the second upper guide slot side of each upper guide slot are arranged at an angle between 80° and 120° relative to each other, and wherein the first lower guide slot side and the second lower guide slot side of each lower guide slot are arranged at an angle between 80° and 120° relative to each other.

18. The back plate of claim 15, wherein the first upper guide slot side of each upper guide slot is longer than the second upper guide slot side, and wherein the first lower guide slot side of each lower guide slot is longer than the second lower guide slot side.

19. The back plate of claim 15, wherein the upper guide slots and the lower guide slots are configured to bend the webbing material of the first and second shoulder straps in a manner so as to prevent bunching of the webbing material.

* * * * *